US011596968B2

(12) United States Patent
Rademacher et al.

(10) Patent No.: US 11,596,968 B2
(45) Date of Patent: Mar. 7, 2023

(54) APPLICATOR AND APPLICATION METHOD

(71) Applicant: Dürr Systems AG, Bietigheim-Bissingen (DE)

(72) Inventors: Lothar Rademacher, Bietigheim-Bissingen (DE); Jürgen Körmöci, Sersheim (DE); Dmitri Noak, Stuttgart (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 533 days.

(21) Appl. No.: 16/344,159

(22) PCT Filed: Feb. 7, 2018

(86) PCT No.: PCT/EP2018/052998
§ 371 (c)(1),
(2) Date: Apr. 23, 2019

(87) PCT Pub. No.: WO2018/153663
PCT Pub. Date: Aug. 30, 2018

(65) Prior Publication Data

US 2019/0329283 A1 Oct. 31, 2019

(30) Foreign Application Priority Data

Feb. 24, 2017 (DE) ..... 10 2017 001 780.8

(51) Int. Cl.
*B05C 5/02* (2006.01)
*B05B 13/02* (2006.01)
*B05B 13/04* (2006.01)

(52) U.S. Cl.
CPC ..... *B05C 5/0212* (2013.01); *B05B 13/0278* (2013.01); *B05B 13/0452* (2013.01)

(58) Field of Classification Search
CPC ..... B05C 17/0052
(Continued)

(56) References Cited

U.S. PATENT DOCUMENTS 4,229,136 A * 10/1980 Panissidi ..... B25J 19/0012 414/673
4,386,717 A * 6/1983 Koob ..... B05C 17/00583 222/94

(Continued)

FOREIGN PATENT DOCUMENTS

CN 101674895 A 3/2010
CN 2018892727 U 7/2011

(Continued)

OTHER PUBLICATIONS

English translation of JP2015202427.*

(Continued)

*Primary Examiner* — Charles Capozzi
(74) *Attorney, Agent, or Firm* — Bejin Bieneman PLC

(57) ABSTRACT

The disclosure concerns an applicator for applying a coating agent (e.g. sealing agent) to a component, in particular for sealing or bonding a flanged seam to the motor vehicle body component. The applicator in accordance with the disclosure first has a nozzle for dispensing the coating agent in a specific jet direction onto a component surface of the component to be coated. In addition, the applicator has a nozzle carrier for positioning the nozzle. The nozzle carrier is hollow on at least part of its length to pass the coating agent. Furthermore, the nozzle carrier comprises a plurality of limbs arranged one behind the other and angled relative to each other. The nozzle is arranged on the nozzle carrier, in particular on the distal limb of the nozzle carrier. The disclosure provides that a spacer, which projects from the distal limb in the jet direction and rests on the component surface of the component to be coated in the coating operation, is mounted externally on the nozzle carrier and thereby sets a predetermined application distance between the nozzle and the component surface.

29 Claims, 9 Drawing Sheets

(58) Field of Classification Search
USPC ..... 118/305
See application file for complete search history.

(56) References Cited

U.S. PATENT DOCUMENTS

| | | | | |
|---|---|---|---|---|
| 9,364,850 | B1 * | 6/2016 | Anderson | B05C 17/0245 |
| 9,505,020 | B2 | 11/2016 | Rademacher | |
| 2010/0075058 | A1 * | 3/2010 | Rademacher | B25J 17/0208 427/427.3 |
| 2011/0091657 | A1 | 4/2011 | Rademacher | |
| 2021/0187541 | A1 * | 6/2021 | Wang | B33Y 50/02 |

FOREIGN PATENT DOCUMENTS

| | | | |
|---|---|---|---|
| CN | 102224012 | A | 10/2011 |
| CN | 203565302 | U | 4/2014 |
| CN | 103909046 | A | 7/2014 |
| CN | 105555419 | A | 5/2016 |
| CN | 106079912 | A | 11/2016 |
| CN | 106391392 | A | 2/2017 |
| DE | 10 2008 027994 | B3 | 4/2010 |
| DE | 10 2015 209347 | A1 | 11/2016 |
| JP | 2015202427 | A | 11/2015 |
| KR | 1020110016475 | A | 2/2011 |
| KR | 1020120057089 | A | 6/2012 |

OTHER PUBLICATIONS

KIPO Notice of Allowance dated Nov. 19, 2021 for Application No. KR10-2019-7021294 (4 pages; with English translation).
Chinese Patent Office Notification of Grant dated Jul. 1, 2021 for Application No. CN201880004364.3 (10 pages; with English translation).
International Search Report and Written Opinion for PCT/EP2018/052998 dated May 23, 2018 (10 pages; with English translation).

* cited by examiner

APPLICATOR AND APPLICATION METHOD

CROSS-REFERENCE TO RELATED APPLICATIONS

This application is a national stage of, and claims priority to, Patent Cooperation Treaty Application No. PCT/EP2018/052998, filed on Feb. 7, 2018, which application claims priority to German Application No. DE 10 2017 001 780.8, filed on Feb. 24, 2017, which applications are hereby incorporated herein by reference in their entireties.

The disclosure concerns an applicator for applying a coating agent (e.g. sealant) to a component (e.g. motor vehicle body component), in particular for sealing or bonding a flanged seam on a motor vehicle body component. The disclosure also includes a corresponding application method.

BACKGROUND

Motor vehicle body components (e.g. doors or hoods) often have so-called flange seams in which one sheet metal part is flanged around an edge of another sheet metal part, whereby the two sheet metal parts can then be glued together. There is a risk that moisture will penetrate into the gap between the two sheet metal parts and lead to corrosion. It is therefore known to apply a sealing compound to the flanged seam between the two sheet metal parts in order to seal the flanged seam and thus reliably prevent the penetration of moisture and associated corrosion.

An applicator is known from U.S. Pat. No. 9,505,020 B2, which makes it possible to coat a flanged seam on the back of a motor vehicle door without having to open the door. This applicator has a nozzle carrier with several limbs that are angled relative to each other. This allows the nozzle carrier to pass through the gap between two adjacent, laterally overlapping motor vehicle body components (e.g. door and fender), so that the nozzle is then on the rear side and the flanged seam can be coated. This applicator usually works without contact, i.e. contact between the applicator on the one hand and the vehicle body component on the other hand should be avoided.

This contactless application method is associated with various disadvantages, which are briefly described below.

A problem with the non-contact application method is that the flanged seam to be coated is located on the rear side of the vehicle body components and is therefore not directly visible, which makes programming ("teaching") the application paths more difficult.

In addition, the alignment of the coating nozzle relative to the component surface is not visible, but can only be guessed at, which makes programming more difficult.

The programming of the desired application path is therefore only iterative in practice. The first step is to carry out programming that is as good as possible. Then coating agents are applied with the initial programming. The application picture is then examined, for example by opening the motor vehicle door and looking at the flanging seam on the inside of the motor vehicle door. This inspection of the quality of the sealed flange seam then allows conclusions to be drawn in order to optimize the programming. For example, motion parameters of the robot and application parameters can be adjusted to optimize the coating result. This iterative optimization of the programming is carried out until the application result is satisfactory.

An alternatively possible offline programming does not solve this problem because the tolerance chains are too large when transferring offline programming to a real coating situation. In practice, the vehicle body components to be coated are conveyed by a conveyor along a paint sealing line, whereby the conveyor only has a relatively rough positioning tolerance when positioning the vehicle bodies, which leads to correspondingly large positioning inaccuracies. Added to this is the positioning tolerance of the multi-axis application robot that guides the applicator. Further influences on the tolerance chain result from the manufacturing tolerances of the respective body. Part of this tolerance chain can be eliminated by using (optical) measurement systems. These systems measure relevant body geometries, such as edges of the doors to be coated. However, these measuring methods also have limited accuracies, so that only a part of the described tolerance chain can be compensated.

Programming is therefore very time- and cost-intensive in practice.

As an alternative to the non-contact application method described above, state-of-the-art tactile application methods are also known in which the applicator is in contact with the component to be coated during application. In a manual application, for example, the operator can place a suitably designed nozzle against the edge of the door to be coated and then pull the nozzle along the edge of the component as the material leaves the nozzle opening. By placing the nozzle against the component edge, reproducible guidance is ensured. For example, the nozzle opening and thus the applied path have the same distance from the door edge. However, the nozzle carrier must be of a correspondingly stable design. This usually leads to a relatively large diameter of the nozzle needle, so that in practice it is not possible to guide the nozzle carrier through the door gap when the door is closed. In practice, the doors are therefore usually opened by the operator in order to be able to coat a flanged seam on the rear side. This also has the advantage for the operator that he can simultaneously view the quality of the application result.

Furthermore, it is known from the state of the art that this tactile process is used in conjunction with application robots that automatically guide the applicator. Here, the applicator is attached to the application robot by means of a flexible joint, whereby the flexible joint allows an evasive movement of the applicator in order to avoid mechanical overloads during contact between the applicator and the component to be coated.

These tactile procedures, which are also well known, also have certain disadvantages, which are briefly described below.

First of all, it should be noted that flanging seams on the rear side of motor vehicle doors are generally not accessible when the doors are closed if body parts overlap in these areas. The reason for this is that, for reasons of rigidity, the diameter of the nozzle carrier is usually larger than the gap width between the adjacent components.

In practice, it is therefore necessary to open the respective door in order to coat a flanged seam on the rear side of a motor vehicle door. However, this requires a cycle time which is lost for the actual application. Thus, it may not be possible to completely coat a vehicle body in one cycle, which requires further cycles and thus further investments.

In addition, an additional handling robot ("door opener") is usually required to open and close the vehicle doors, which entails additional investment costs and additional space requirements in the paint shop.

If, on the other hand, the car body doors are opened and closed by the application robot itself, no additional handling robot is required, but gripping tools (e.g. hooks) must be attached to the application robot in order to be able to grip the door. However, these additional tools impair the actual application process and are therefore also disadvantageous. Furthermore, in this case an additional mechanical device must be installed which locks the opened door in the desired position. In addition to the additional investment costs, this also requires additional space.

Further disadvantages result from the fact that in the tactile application process the nozzle is placed directly on the flanging seam. As a result, the nozzle opening cannot rest directly on the flanged seam, but must be inclined at an angle of, for example, 45° in order to be able to apply the sealant by pulling. As a result, the energy of the spray jet when it hits the component surface is comparatively low, which can lead to flaws (e.g. air inclusions).

Furthermore, due to the contact between the nozzle and the component surface, there is a risk that the nozzle will get caught on elevations, which can be caused by welding spots or adhesive leaks, for example. This can cause the applicator to vibrate or chatter further along the application path, which also impairs the quality of the application. In the worst case, ductile deformation or breakage of the nozzle needle may occur.

Finally, no material overlap and no hem can be coated with the tactile method, which is, however, particularly necessary at component corners.

BRIEF DESCRIPTION OF THE DRAWINGS

FIGS. 1A and 1B show different views of a first example of an applicator according to the disclosure used to apply a sealant to a flanged seam on the back of a motor vehicle body component, as is also known from U.S. Pat. No. 9,505,020 B2, so that reference is made to this publication as a supplement.

Figure 1A:
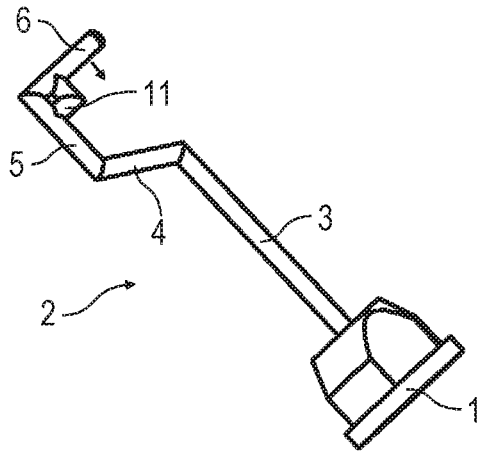
FIG. 1A shows a side view of an applicator according to the disclosure with a spacer, FIG. 1B a side view of the applicator from FIG. 1A at a flange seam, FIG. 2A a side view of another embodiment of an applicator according to the disclosure, FIG. 2B an enlarged side view of the applicator from FIG. 2A at a flange seam.

The applicator according to the disclosure initially has a mounting flange 1 that can be mounted on a multi-axis application robot.

DETAILED DESCRIPTION

The applicator according to the disclosure is used to apply a coating such as a sealant (e.g. PVC material; PVC: polyvinyl chloride). The term "coating agent" used in the disclosure is, however, to be understood generally and may basically also include other types of coating agent, in particular thick materials, such as insulating materials for acoustic or thermal insulation or adhesives, to name but a few examples.

It should also be mentioned that the applicator is preferably used to apply the coating (e.g. sealant) to a vehicle body component (e.g. door), in particular to seal or bond a flanged seam on the vehicle body component. However, the term "component" used in the context of the disclosure is to be understood generally and is not limited to motor vehicle body components.

In accordance with the known applicator according to U.S. Pat. No. 9,505,020 B2, the applicator according to the disclosure first has a nozzle to apply the coating agent in a certain jet direction to a component surface of the component to be coated.

In addition, in accordance with the known applicator, the applicator according to the disclosure has a nozzle carrier to position the nozzle, the nozzle carrier having multiple limbs arranged one behind the other and angled relative to each other. The individual limbs are preferably straight when viewed on their own, but the individual limbs can also be curved when viewed on their own. The nozzle mentioned above is located on the nozzle carrier and is preferably attached to the distal limb of the nozzle carrier. It should also be noted that the nozzle carrier is hollow over at least part of its length to pass the coating. In the case of the applicator according to the disclosure, the nozzle carrier serves on the one hand to convey the coating agent through and on the other hand to position the nozzle.

It was already mentioned at the beginning that the applicator according to U.S. Pat. No. 9,505,020 B2 is used for contactless application, which is associated with the problems described at the beginning. By contrast, the applicator in accordance with the disclosure is characterized by the fact that a spacer is arranged on the outside of the nozzle carrier (e.g. on the distal limb of the nozzle carrier), which projects from the distal limb in the direction of the jet and rests on the component surface of the component to be coated during coating operation, thereby setting a predetermined application distance between the nozzle and the component surface, in particular an application distance of essentially 2 mm, 3 mm, 4 mm or 5 mm, or any intermediate values.

The spacer allows the nozzle to not rest directly on the component surface—in contrast to the known tactile application methods—so that the nozzle can be aligned at right angles to the component surface with the jet direction. Use of the spacer allows the applied spray jet to hit the component surface with relatively maximized energy. In addition, the lack of contact between the nozzle on the one hand and the component surface on the other hand avoids so-called chatter marks during application.

The spacer allows the applicator with the nozzle to not stick to surface elevations caused, for example, by adhesive leaks from a flanged seam or welding spots. The application distance between the nozzle on the one hand and the component surface on the other hand may therefore be adjusted by means of the spacer so that the application distance is greater than the unevenness height of the surface elevations, which can be caused by adhesive leaks or welding spots. This is possible because the nozzle then has no contact with the surface during movement over the component surface, even at the surface elevations.

The two distal limbs of the nozzle carrier are preferably angled relative to each other and include an angle, as is the case with the applicator according to U.S. Pat. No. 9,505,020 B2. In the case of the applicator according to the disclosure, the spacer can also be used to stabilize this angle between the two distal limbs of the nozzle carrier. For this purpose, the spacer may be arranged in the angle between the two distal limbs of the nozzle carrier and connected to the two distal limbs, for example by welding, bonding or by a one-piece shaping of the spacer and the distal limbs of the nozzle carrier. The spacer thus stabilizes the two distal limbs of the nozzle carrier and prevents the two distal limbs of the nozzle carrier from bending relative to each other through the formation of a so-called bend-resistant corner.

In another example of the disclosure, the spacer is shaped in the form of an anvil and lies on the surface of the component with its anvil surface during coating operation. Here, the distal limbs of the nozzle carrier merge into one another at the angle, preferably via a pipe bend, without kinking, the spacer being connected to the pipe bend, for example by welding.

In another example of the disclosure, however, the spacer consists of an elbow piece which is arranged at the angle between the two distal limbs of the nozzle carrier and is connected to the two distal limbs, for example by welding. In this variant of the disclosure, the two distal limbs of the nozzle carrier connect to each other at the angle preferably with a kink, in particular with a right-angled kink.

With the applicator according to the disclosure, the nozzle carrier may be angled so that it can protrude through a gap between two adjacent, laterally overlapping motor vehicle body components (e.g. door and fender) from a front side to a rear side of the motor vehicle body components. The proximal limb of the nozzle carrier may then be located on the front side of the vehicle body components during coating operation and is guided there by an application robot, which is also located on the front side. The distal limb of the nozzle carrier with the nozzle, on the other hand, may be located on the rear side of the motor vehicle body component during coating operation, so that the nozzle can coat a flanged seam on the rear side, for example. In contrast, a middle limb of the nozzle carrier protrudes through the gap between the laterally overlapping motor vehicle body components from the front to the rear of the motor vehicle body components. Such a design of the nozzle carrier is known from U.S. Pat. No. 9,505,020 B2, which is fully incorporated herein by reference.

It should be mentioned here that the proximal limb of the nozzle carrier can be mechanically more stable than the distal limbs and/or the middle limb of the nozzle carrier. This is because the proximal limb is positioned at the front of the motor vehicle body components to be coated and does not have to protrude through the relatively narrow gap between the adjacent motor vehicle body components, so that there are no restrictions with regard to the external cross-section of the proximal limb of the nozzle carrier. The proximal limb of the nozzle carrier can therefore have such a large external cross-section that it does not fit through the gap between the laterally overlapping vehicle body components. Furthermore, the larger external cross-section of the proximal limb of the nozzle carrier also allows a larger internal cross-section for the passage of the coating agent, which is advantageous because the hollow channel in the proximal hollow limb of the nozzle carrier then forms a lower flow resistance for the coating agent. The proximal hollow limb of the nozzle carrier can therefore have a larger internal cross section than the distal limbs and/or the middle limb of the nozzle carrier.

It should also be mentioned that the nozzle carrier can at least partially consist of a material with a shape memory, for example a nickel-titanium alloy such as Nitinol or Titan-Flex. This material selection is particularly advantageous for the middle limb and/or the distal limbs of the nozzle carrier, since these limbs can be deformed in contact with the components to be coated. It should be mentioned here that the term shape memory used in the disclosure must be distinguished from materials which are merely elastic and return to their original position after mechanical deflection.

With the applicator according to the disclosure, the different limbs of the nozzle carrier can differ with regard to the bending stiffness. Thus, within the scope of the disclosure, it is possible that the distal limb or the two distal limbs of the nozzle carrier are more rigid than the middle limb of the nozzle carrier, which projects through the gap between the laterally overlapping vehicle body components during coating operation.

This greater bending stiffness can be achieved, for example, by increasing the wall thickness. For example, the wall thickness can be at least 0.15 mm, 0.175 mm, 0.2 mm or even at least 0.22 mm to achieve sufficient bending stiffness. On the other hand, the outer diameter is preferably a maximum of 1.75 mm, 1.7 mm or even a maximum of 1.65 mm, so that the nozzle carrier fits through the gap between the laterally overlapping vehicle body components. The inside diameter of the hollow channel in the respective limb, on the other hand, is preferably not more than 1.5 mm, 1.4 mm, 1.3 mm or even not more than 1.2 mm.

It has already been briefly mentioned above that the nozzle carrier of the applicator according to the disclosure can have a similar structure to the nozzle carrier of the conventional applicator according to U.S. Pat. No. 9,505,020 B2. For example, the nozzle carrier can have four limbs which are arranged one behind the other, lie in a common plane and are angled to each other.

The applicator can be mounted on an application robot by means of an elastically flexible joint, whereby the elastic joint enables evasive movements of the applicator in order to avoid damage to the applicator and the component to be coated in the event of excessive contact between the applicator on the one hand and the component to be coated on the other hand. The flexible joint allows the applicator to avoid movement in two spatial directions, preferably parallel to the component surface and transverse to the component surface. In coating operation, the nozzle carrier can then be placed against the component edge of the component to be coated and guided along the component edge so that the component edge guides the applicator in one spatial direction. The contact between the spacer on the one hand and the component surface on the other hand then causes the applicator to be guided in a further spatial direction.

It should be mentioned here that the elastic joint between the applicator and the application robot preferably generates a counterforce that is essentially independent of the size of the evasive movement. For example, the counterforce can be in the range of 1N-15N, 2N-10N, 3N-8N or 4N-5N.

When the applicator is moved over the component surface, the coating agent (e.g. sealant) is then released from the applicator nozzle in a specific jet direction onto the component surface, whereby the nozzle maintains a specific application distance from the component surface of the component to be coated.

With reference to the drawings, the applicator has a nozzle carrier 2 consisting of several limbs 3-6 arranged one behind the other in a common plane and angled relative to each other. The angle between the two limbs 3 and 4 and the angle between the two limbs 4 and 5 is approximately 135°. The angle between the two limbs 5 and 6, on the other hand, is preferably perpendicular. It should be noted here that the angles between the individual limbs 3-6 are such that the nozzle carrier 2 can be guided through a gap between two adjacent, laterally overlapping motor vehicle body components (e.g. door and fender). The optimum angles between the individual limbs 3-6 of the nozzle carrier 2 thus also depend on the respective component geometry of the motor vehicle body components.

A nozzle 7 is located on the distal limb 6 of the nozzle carrier 2 to dispense the sealant in the direction of the arrow.

It should also be mentioned that the limbs 3-6 of the nozzle carrier are hollow so that the sealant to be applied can be guided from the mounting flange 1 to the nozzle 7 in the distal limb 6.

The applicator according to the disclosure shown here is particularly suitable for coating a flanged seam 8 of a motor vehicle body component, where a body panel 9 is flanged around the side edge of another body panel 10 at the flanged seam 8. There is a risk of moisture penetrating this flanged seam 8, which can lead to corresponding corrosion. The flanged seam 8 is therefore coated with a sealing agent (e.g. PVC) at the joint between the two body panels 9 and 10 to prevent moisture from penetrating.

For this purpose, the applicator is placed with the limb 5 against the side edge of the flange seam 8 and then moved along the flange seam 8, i.e. in the x-direction and thus perpendicular to the drawing plane. The contact between the limb 5 of the nozzle carrier 2 on the one hand and the side edge of the flanged seam 8 on the other hand guides the applicator in the y-direction.

In addition, the applicator has a spacer 11 which is arranged at the angle between the two distal limbs 5, 6 of the nozzle carrier 2 and in this concrete embodiment consists of a tubular angle piece which is welded to both limbs 5, 6.

On the one hand, the spacer 11 mechanically stabilizes the two distal limbs 5 and 6.

On the other hand, the spacer 11 also rests directly on the component surface of the flange seam 8 during coating and thus adjusts a certain application distance a between the nozzle 7 and the component surface. The spacer 11 thus guides the applicator in the z-direction.

This is advantageous because the nozzle 7 can apply the sealant to the component surface at a right angle to the component surface so that the sealant hits the component surface with maximum flow energy.

In addition, the application distance a is also advantageous because it prevents the nozzle 7 from sticking to uneven surfaces, which can, for example, be caused by an adhesive escaping from the flange seam 8 or by welding spots.

Figure 1B:
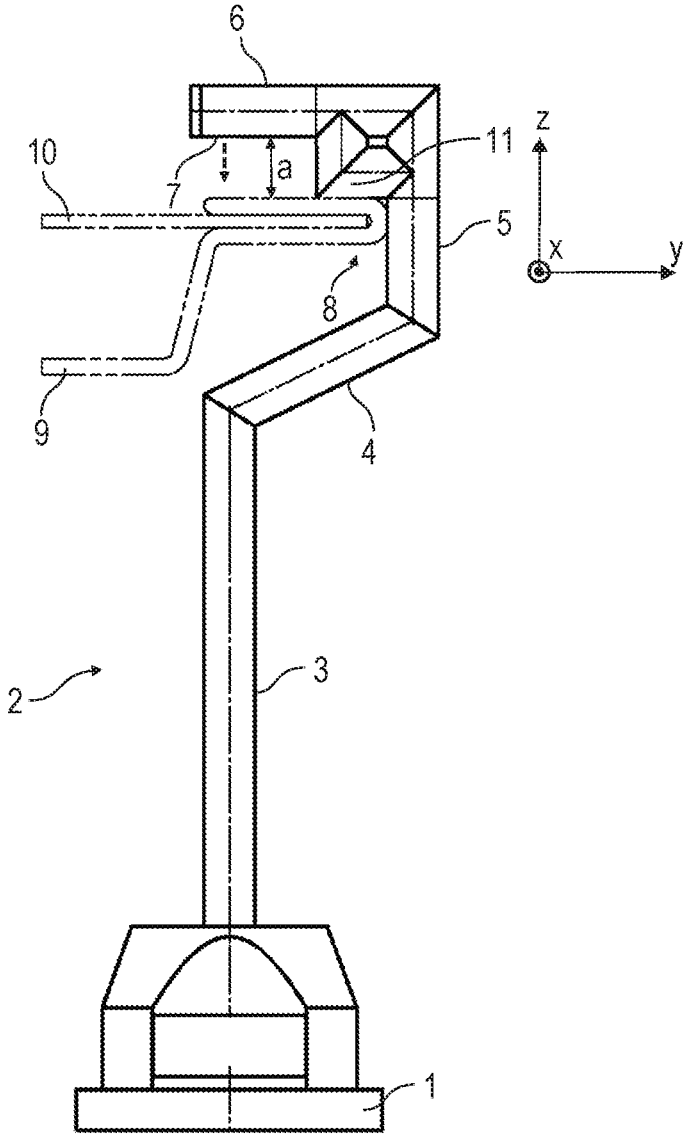
Figure 2A:
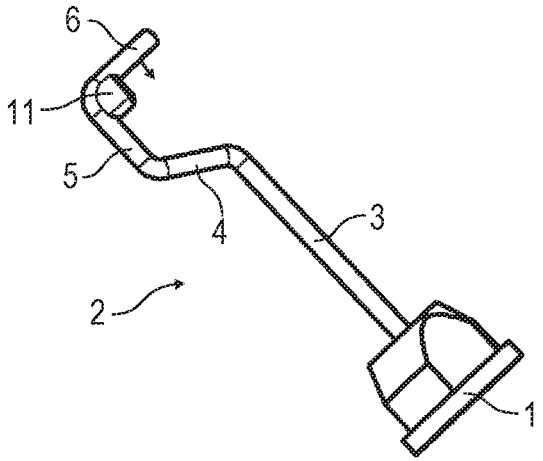
Figure 2B:
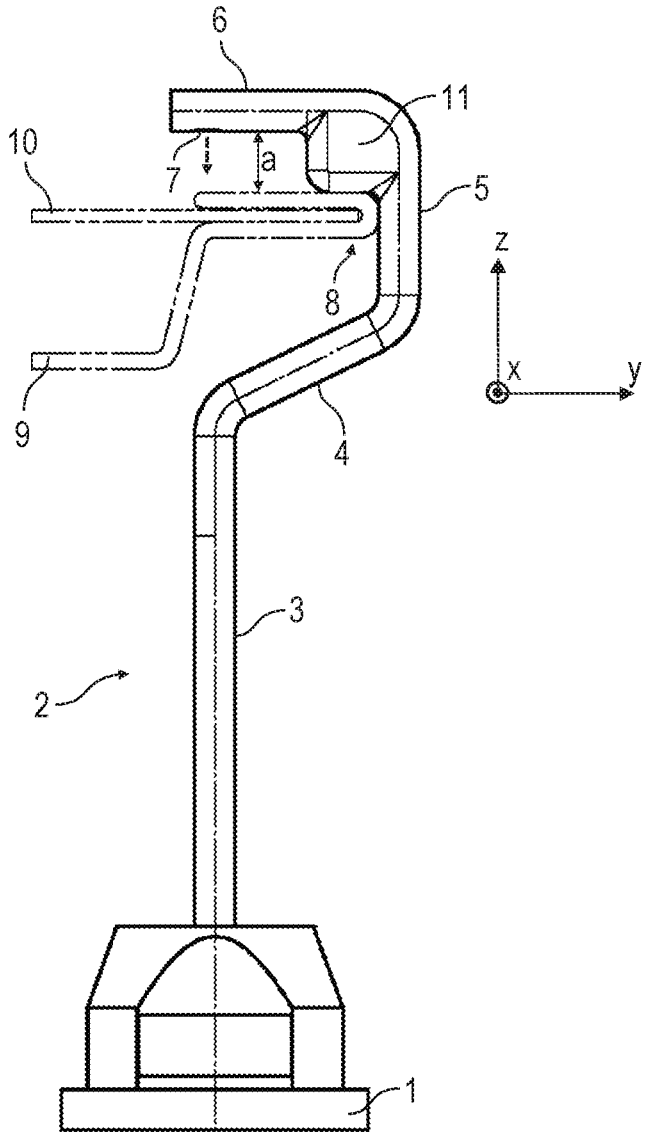

FIGS. 2A and 2B show a second embodiment of an applicator according to the disclosure, this embodiment being largely consistent with the above embodiment shown in FIGS. 1A and 1B, so that reference is made to the above description to avoid repetition, using the same reference signs for corresponding details.

One I feature of this embodiment is that the two distal limbs 5, 6 of the nozzle carrier 2 are not connected to each other with a right-angled bend, as in the embodiment of the FIGS. 1A and 1B. Rather, the two limbs 5, 6 of the nozzle carrier 2 merge into each other without kinking via a pipe elbow 12.

Another feature of this embodiment is that the spacer 11 is not designed as a tubular angle piece, but in the form of an anvil with its anvil surface resting on the surface of the component.

Figure 3:
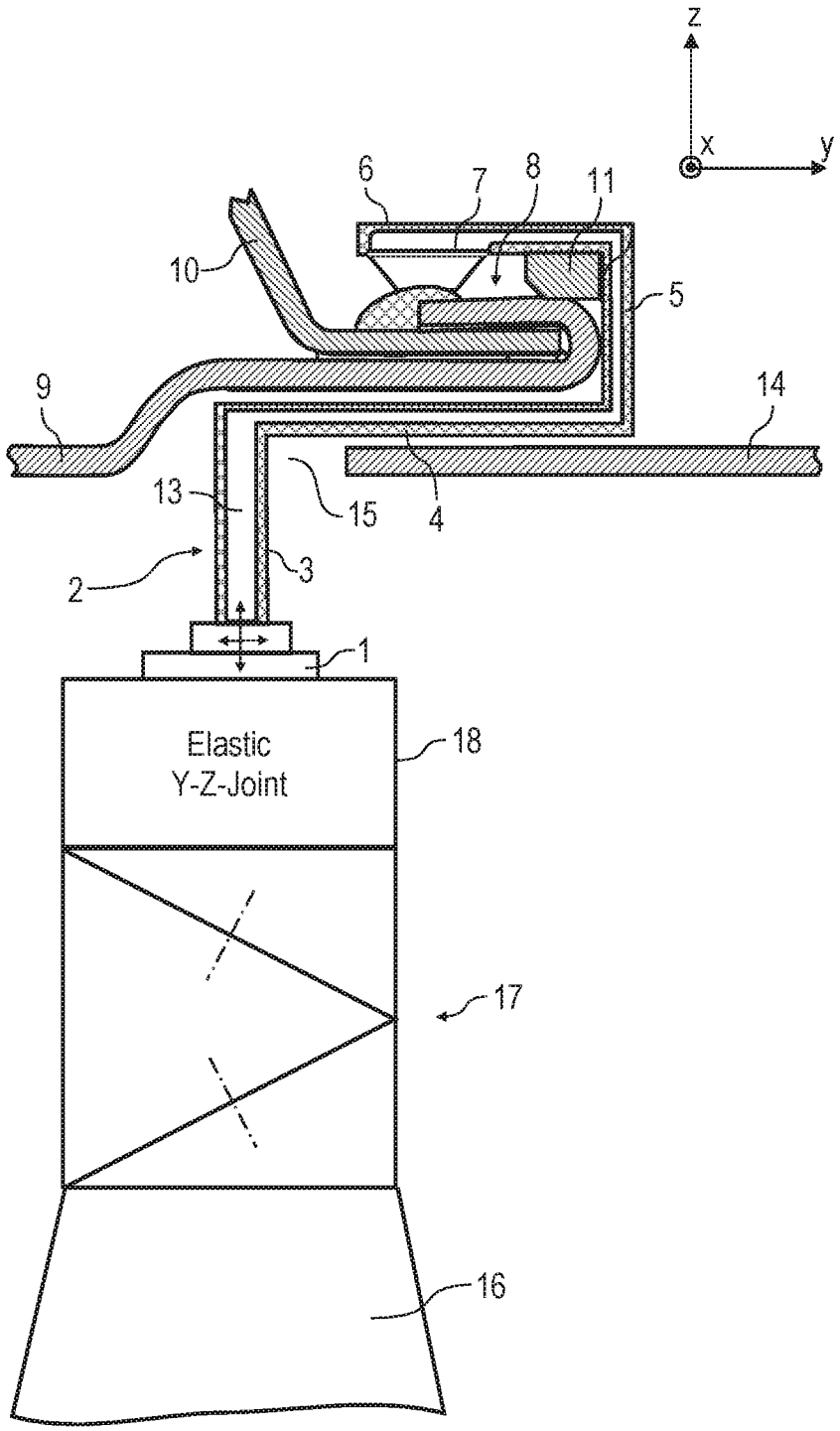
FIG. 3 shows a schematic representation of the guidance of the applicator according to the disclosure with a multi-axis application robot.

FIG. 3 shows a schematic illustration of the guidance of the applicator by means of an application robot. This illustration also largely corresponds to the illustrations described above, so that reference is made to the above description to avoid repetitions, whereby the same reference signs are used for the corresponding details.

In addition to the above illustrations, this drawing also shows that a hollow channel 13 leads from the mounting flange 1 through the entire nozzle carrier to the nozzle 7 in order to pass the sealant through.

Furthermore, it can be seen from the drawing that the two body panels 9, 10 with the flanged seam 8 overlap laterally with another body panel 14, which is shown here only schematically. The applicator protrudes from the front side (in the drawing below) through the gap 15 to the rear side (in the drawing above) in order to be able to coat the flanged seam 8 on the rear side.

In addition, the drawing shows a robot arm 16 and a robot hand axis 17 of a multi-axis application robot with serial robot kinematics. The mounting flange 1 of the applicator according to the disclosure is connected to the robot hand axis 17 via an elastic joint 18, whereby the joint allows 18 evasive movements of the applicator in the y-direction and in the z-direction.

This is advantageous because the applicator with the limb 5 in the y-direction rests against the side edge of the flanged seam 8 and is thus positively guided. The joint 18 enables an evasive movement in the y-direction, thus preventing a mechanical overload of the applicator.

The possibility of an evasive movement in z-direction is advantageous, because the applicator with the spacer 11 rests on the component surface and is therefore positively guided in z-direction, which could lead to mechanical overloads without a compensatory movement.

Figure 4:
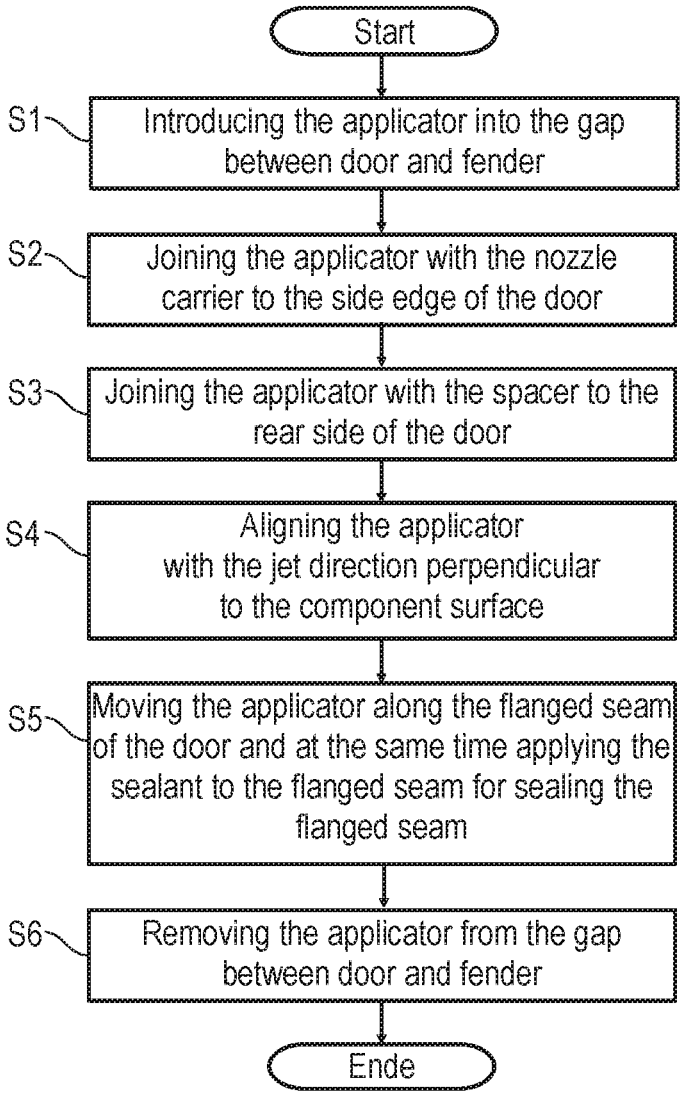
FIG. 4 shows the application method according to the disclosure in the form of a flowchart.

FIG. 4 finally shows the application method according to the disclosure in the form of a flowchart.

In a first step S1, the applicator is inserted into the gap 15 between the door and the fender so that the nozzle 7 is located at the rear of the door.

In a second step S2, the applicator is then placed with the nozzle carrier 2 against the side edge of the door in order to provide mechanical guidance in this spatial direction.

In a step S3, the applicator with the spacer 11 is then placed on the back of the door to ensure mechanical guidance at right angles to the component surface.

In this state, the applicator is then positively guided in two spatial directions.

In a step S4, the applicator is then aligned so that the spray direction is perpendicular or almost perpendicular to the component surface. This offers the advantage that the applied sealant hits the component surface with maximum kinetic energy.

In a step S5, the applicator is then moved along the flanged seam 8 of the door and the sealant is applied to the flanged seam 8 to seal the flanged seam 8.

In a step S6 the applicator is then removed from the gap 15 after coating the flanged seam 8.

FIGS. 5-15 show various variations of the spacer 11, with some of the variations matching the embodiment in FIGS. 1A and 1B, so that reference is made to the above description to avoid repetition, using the same reference signs for corresponding details.

Figure 5:
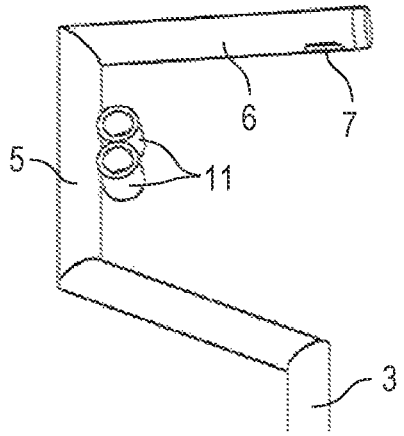
FIGS. 5-15 show different variations of the spacer.

In the example shown in FIG. 5, the spacer 11 consists of two hollow cylinders, both fixed to the penultimate limb 5 of the nozzle holder 2 and aligned with their cylinder axes perpendicular to the plane of the nozzle holder 2.

The two hollow cylinders abut against each other with their outer surfaces, whereby the side edges of the flanged body sheet 9 can be held between the two hollow cylinders of the spacer 11.

Figure 6:
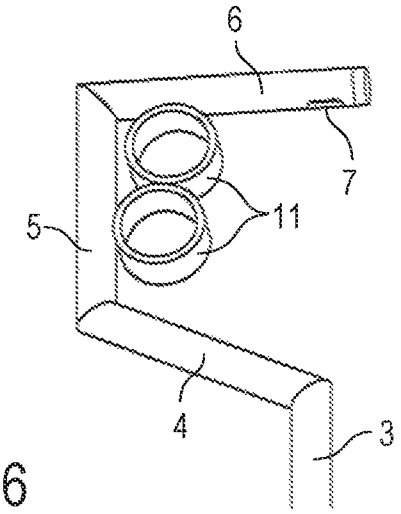

In the example shown in FIG. 6, the two hollow cylinders of the spacer 11 are attached to different limbs 5, 6 of the nozzle carrier 2. Above this, the two hollow cylinders have a slightly larger diameter than in the example shown in FIG. 5.

Figure 7:
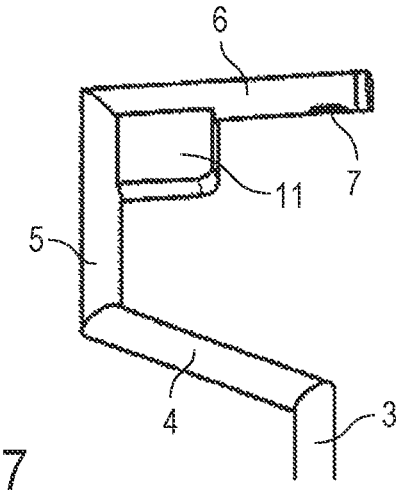

In the example shown in FIG. 7, the spacer 11 consists of a rectangular plate which is fixed at the angle between the two distal limbs 5, 6 and thus reinforces the angle.

Figure 8:
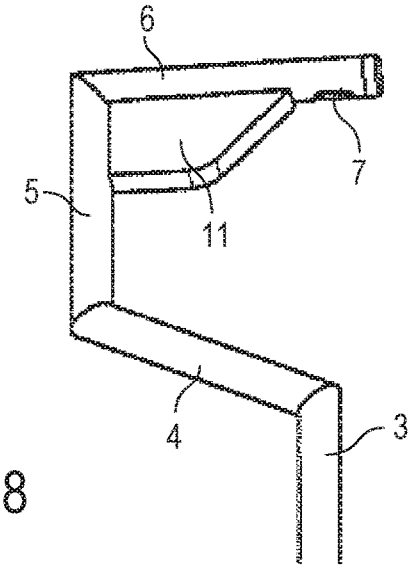

The embodiment in FIG. 8 differs from the embodiment in FIG. 7 in the shape of the plate, which here has the shape of a rectangular trapezoid.

Figure 9:
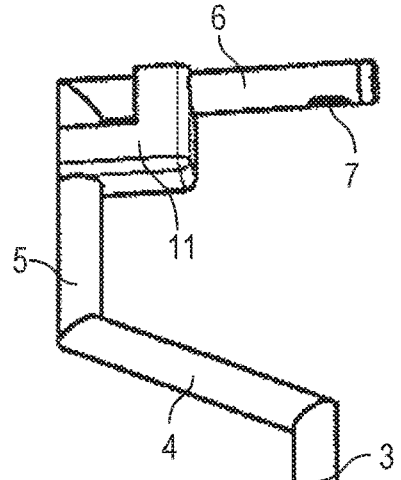
Figure 10:
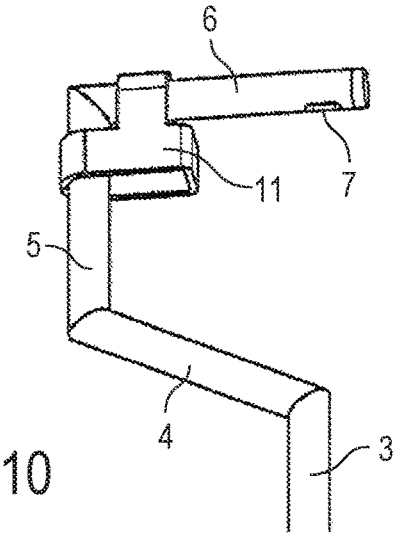
Figure 11:
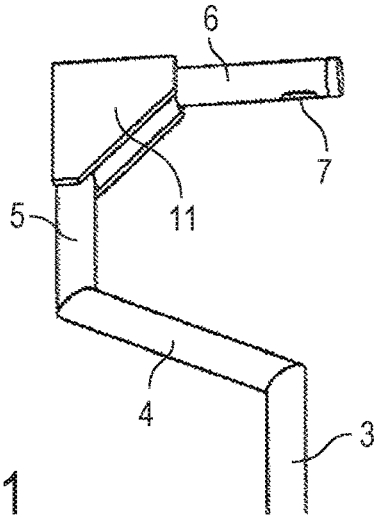

In the embodiments shown in FIGS. 9-11, the spacer 11 consists of plates aligned parallel to the plane of the nozzle carrier 2 and fixed to the nozzle carrier 2 on the opposite sides of the nozzle carrier 2. In the example shown in FIG. 9, the plates are essentially L-shaped, while in the example shown in FIG. 10, the plates are essentially T-shaped. In the embodiment shown in FIG. 11, the plates are essentially triangular.

Figure 12:
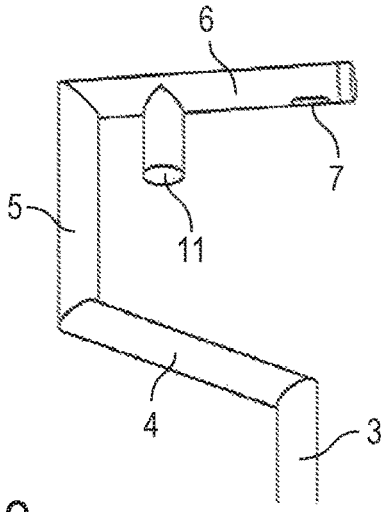
Figure 13:
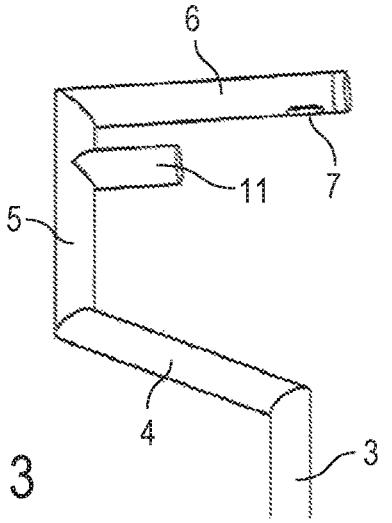

FIGS. 12 and 13 also show modifications in which the spacer 11 consists of a cylinder pin projecting from the last limb 6 (FIG. 12) or from the penultimate limb 5 (FIG. 13).

Figure 14:
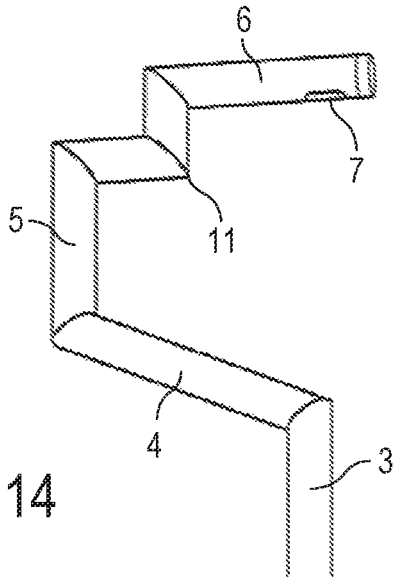

In the embodiment shown in FIG. 14, the spacer 11 consists of a kink in the nozzle carrier 2 between the two distal limbs 5, 6.

Figure 15:
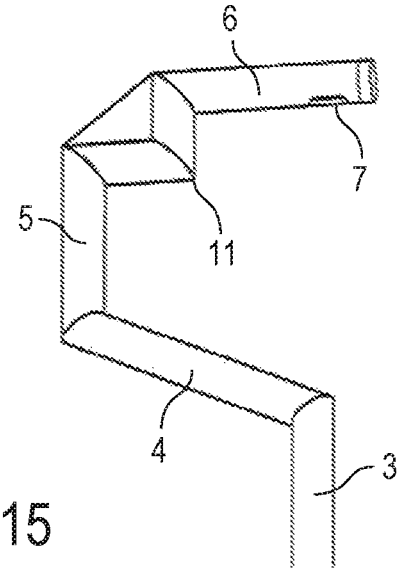

In the embodiment shown in FIG. 15, the spacer 11 also consists of a shaping of the nozzle carrier 2.

Figure 16:
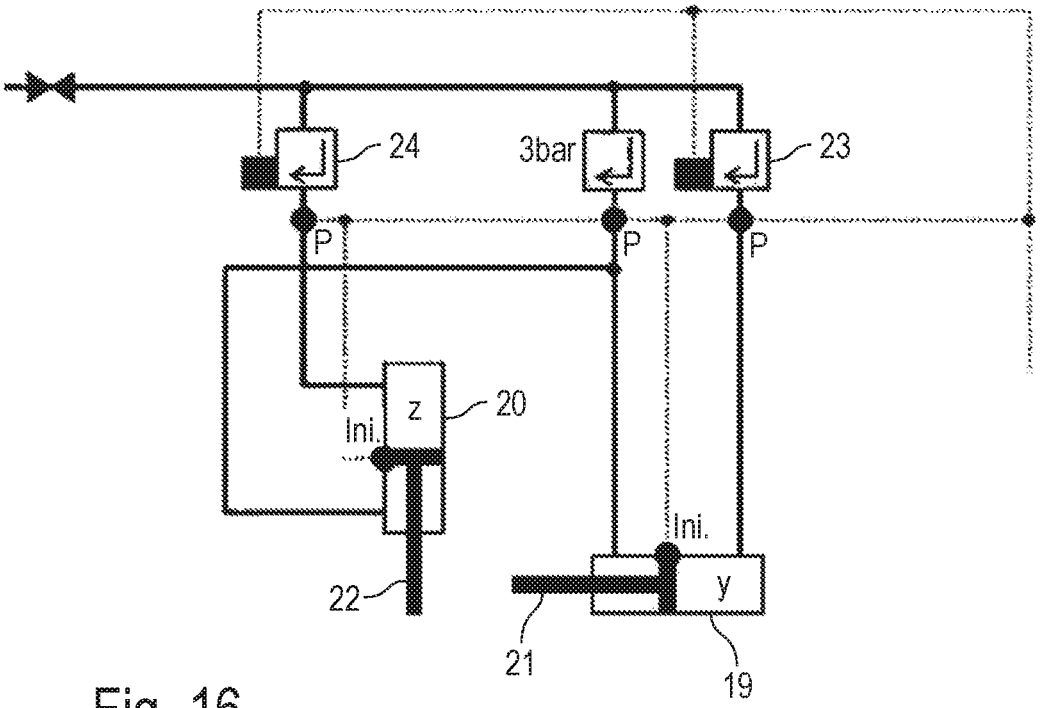
FIG. 16 shows a schematic illustration of an elastic joint that generates a constant counterforce independent of the deflection.

FIG. 16 shows a schematic representation of the flexible joint 18 as shown in FIG. 3, which makes it possible to generate a constant counterforce independent of the deflection of the applicator.

Two pneumatic cylinders 19, 20 are provided for this purpose, in each of which a piston rod 21, 22 can be displaced, whereby the two piston rods 21, 22 flexibly guide the applicator. The piston rod 21 can be moved in the Y-direction, while the piston rod 22 can be moved in the Z-direction. The two pneumatic cylinders 19, 20 are each subjected to a constant differential pressure via a proportional valve 23, 24, which leads to a corresponding counterforce that is constant regardless of the deflection (immersion depth).

The disclosure is not limited to the preferred embodiments described above. Rather, a large number of variants and modifications are possible which also make use of the inventive idea and therefore fall within the scope of protection. In particular, the disclosure also claims protection for the subject-matter and the characteristics of the dependent claims irrespective of the claims referred to in each case and in particular also without the features of the main claim. The disclosure thus comprises various inventive aspects which can enjoy protection independently of each other.

LIST OF REFERENCE SIGNS

1 Mounting flange of the applicator
2 Nozzle carrier
3-6 Limbs of the nozzle carrier
7 Nozzle
8 Flanged seam
9, 10 Body panels
11 Spacer
12 Pipe elbow
13 Hollow channel
14 Body panel
15 Gap
16 Robot arm
17 Robot hand axis
18 Joint
19 Pneumatic cylinder
20 Pneumatic cylinder
21 Piston rod
22 Piston rod
23 Proportional valve
24 Proportional valve
a Application distance

The invention claimed is:

1. Applicator for applying a coating agent, having
a) a nozzle for dispensing the coating agent in a specific jet direction onto a component surface of the component to be coated, and
b) a nozzle carrier for positioning the nozzle, wherein
b1) the nozzle carrier is hollow over at least part of its length to convey the coating agent,
b2) the nozzle carrier has a plurality of limbs which are arranged one behind the other and are angled relative to one another, the plurality of limbs includes a penultimate limb, and
b3) the nozzle is arranged on the nozzle carrier,
c) wherein a spacer is mounted on the outside of the nozzle carrier and spaced from the nozzle in a direction perpendicular to the jet direction along the nozzle carrier between the nozzle and the penultimate limb, which spacer projects from a first distal limb of the plurality of limbs in the jet direction and, in coating operation, rests on the component surface of the component to be coated, and thereby sets a predetermined application distance between the nozzle and the component surface.

2. Applicator according to claim 1, wherein the applicator is adapted for applying a sealing agent to a motor vehicle body component for sealing or bonding a flanged seam on the motor vehicle body component.

3. Applicator according to claim 1, wherein
a) the component surface of the component to be coated has surface elevations which originate from adhesive exits at a flange seam or from welding points and have a specific unevenness height, and
b) the spacer adjusts the application distance such that the application distance is greater than the unevenness height of the surface elevations to avoid collision between the nozzle and the surface elevations.

4. Applicator according to claim 1, wherein
a) the first distal limb and the penultimate limb of the plurality of limbs of the nozzle carrier are angled relative to each other and include an angle, and
b) the spacer is arranged at the angle between the first distal limb and the penultimate limb of the nozzle carrier and is connected to the first distal limb and the penultimate limb, so that the spacer mechanically stabilizes the angle between the first distal limb and the penultimate limb of the nozzle carrier.

5. Applicator according to claim 4, wherein the first distal limb and the penultimate limb of the nozzle carrier merge into one another at the angle via a pipe bend without kinking, the spacer being connected to the pipe bend.

6. Applicator according to claim 4, wherein the first distal limb and the penultimate limb of the nozzle carrier adjoin one another at the angle with a kink, the spacer being an angle piece.

7. Applicator according to claim 1, wherein
a) the nozzle carrier is angled in such a way that it can project through a gap between two adjacent, laterally overlapping motor vehicle body components from a front side to a rear side of the motor vehicle body components, and b) a proximal limb of the plurality of limbs of the nozzle carrier is located on the front side of the motor vehicle body components during coating operation and is guided by an application robot located on the front side, c) the first distal limb of the nozzle carrier with the nozzle is located during coating operation on the rear side of the motor vehicle body components in order to apply the coating agent to the rear side of the motor vehicle body components, and d) a middle limb of the nozzle carrier projects through the gap between the laterally overlapping motor vehicle body components from the front side to the rear side of the motor vehicle body components.

8. Applicator according to claim 7, wherein a) the proximal limb of the nozzle carrier is mechanically more stable than the first distal limb the penultimate limb, and the middle limb of the nozzle carrier, and b) the proximal limb of the nozzle carrier has such a large external cross-section that it does not fit through the gap between the laterally overlapping motor vehicle body components, and c) the proximal limb of the nozzle carrier has a larger internal cross-section than the first distal limb and the middle limb of the nozzle carrier.

9. Applicator according to claim 1, wherein the nozzle carrier consists at least partially of a material with a shape memory.

10. Applicator according to claim 9, wherein the material with the shape memory is selected from a group consisting of nitinol and nickel-titanium alloy.

11. Applicator according to claim 9, wherein a middle limb of the plurality of limbs of the nozzle carrier, which in coating operation projects through the gap between the laterally overlapping motor vehicle body components from the front side to the rear side of the motor vehicle body components, consists of the material with the shape memory.

12. Applicator according to claim 1, wherein the nozzle carrier consists at least partially of an elastic material.

13. Applicator in accordance with according to claim 1, wherein, a) the first distal limb of the nozzle carrier is flexurally more rigid than a middle limb of the plurality of limbs of the nozzle carrier, which in coating operation projects through a gap between laterally overlapping motor vehicle body components from a front side to a rear side of the motor vehicle body components, and b) the first distal limb of the nozzle carrier has a greater wall thickness than the middle limb of the nozzle carrier, which in coating operation projects through the gap between the laterally overlapping motor vehicle body components from the front side to the rear side of the motor vehicle body components.

14. Applicator according to claim 1, wherein a middle limb of the plurality of limbs of the nozzle carrier, which in coating operation projects through a gap between laterally overlapping motor vehicle body components from a front side to a rear side of the motor vehicle body components, has the following dimensions:

a) a wall thickness of at least 0.15 mm in order to achieve a bending stiffness, and b) an outer diameter of at most 1.75 mm, so that the nozzle carrier fits through the gap between the laterally overlapping motor vehicle body components, and c) an inside diameter not exceeding 1.5 mm.

15. Applicator according to claim 1, wherein a) the nozzle carrier has the first distal limb which carries the nozzle, and b) the nozzle carrier has the penultimate limb which adjoins the first distal limb and is bent with respect to the first distal limb at a specific kink angle, the kink angle between the first distal limb and the penultimate limb being in the range 70°-110°, and c) the nozzle carrier has a third limb which adjoins the penultimate limb and is bent with respect to the penultimate limb at a specific kink angle, the kink angle between the penultimate limb and the third limb being in the range 90°-135°, and d) the nozzle carrier has a proximal fourth limb which adjoins the third limb and is bent with respect to the third limb at a specific kink angle, the kink angle between the third limb and the proximal fourth limb lying in the range 90°-135°, and e) all limbs of the nozzle carrier lie in a common plane.

16. Applicator according to claim 1, wherein the spacer comprises two cylinders, which abut against each other with respective shell surfaces and are fixed to the first distal limb and the penultimate distal limb of the plurality of limbs of the nozzle carrier.

17. Applicator according to claim 16, wherein one cylinder of the spacer is fastened to the penultimate limb of the nozzle carrier, while the other cylinder of the spacer is fastened to the first distal limb of the nozzle carrier.

18. Applicator according to claim 1, wherein the spacer consists of a cylindrical pin which projects from the last limb of the nozzle carrier transversely to the first distal limb.

19. Applicator according to claim 1, wherein the spacer consists of a rectangular plate fixed at the angle between the first distal limb and the penultimate limb of the nozzle carrier.

20. Applicator according to claim 1, wherein the spacer consists of a plate in the form of a rectangular trapezoid fixed at the angle between the first distal limb and the penultimate limb of the nozzle carrier.

21. Applicator according to claim 1, wherein a) the spacer comprises one or two plates which are aligned parallel to a plane of the nozzle carrier and are connected on one or both sides to the nozzle carrier, and b) the one or two plates is substantially triangular, L-shaped or T-shaped.

22. Applicator according to claim 1, wherein the spacer is formed by a kink in the nozzle carrier.

23. Applicator according to claim 1, wherein the spacer is formed by a triangle of the nozzle carrier.

24. Application robot with the applicator according to claim 1.

25. Application robot according to claim 24, wherein a) the applicator is mounted on the application robot by means of an elastically flexible joint, the elastic joint permitting evasive movements of the applicator in order to prevent damage to the applicator and the component to be coated, and b) the joint permits evasive movements of the applicator parallel to the component surface, and c) the joint allows evasive movements of the applicator transversely to the component surface.

26. Application robot according to claim 25, wherein a) the elastic joint generates a counterforce during an evasive movement of the applicator, and b) the counterforce is substantially independent of the size of the evasive motion, and c) the counterforce is in the range 1N-15N.

27. Application robot according to claim 25, wherein the flexible joint comprises at least one pneumatic cylinder to which a constant differential pressure is applied.

28. Applicator according to claim 1, wherein the first distal limb of the nozzle carrier is hollow and flexurally more rigid than a middle limb of the plurality of limbs of the nozzle carrier, which in coating operation projects through a gap between laterally overlapping motor vehicle body components from a front side to a rear side of the motor vehicle body components, the middle limb being hollow and open at opposing ends.

29. An applicator for applying a coating agent, comprising:

a) a nozzle for dispensing the coating agent in a specific jet direction onto a component surface of the component to be coated, and b) a nozzle carrier for positioning the nozzle, wherein b1) the nozzle carrier is hollow over at least part of its length to convey the coating agent, b2) the nozzle carrier has a plurality of limbs which are arranged one behind the other and are angled relative to one another, and b3) the nozzle is arranged on the nozzle carrier, c) wherein a spacer is mounted on the outside of the nozzle carrier, which spacer projects from a first distal limb of the plurality of limbs in the jet direction and, in coating operation, rests on the component surface of the component to be coated, and thereby sets a predetermined application distance between the nozzle and the component surface, the spacer comprises two cylinders, which abut against each other with respective shell surfaces and are fixed to the first distal limb and a second distal limb of the plurality of limbs of the nozzle carrier.

* * * * *